US011746587B1

(12) United States Patent
Hildreth

(10) Patent No.: US 11,746,587 B1
(45) Date of Patent: Sep. 5, 2023

(54) DOORFRAME FASTENING DEVICE AND METHOD OF USE

(71) Applicant: Chad Joseph Hildreth, Lake Nebagamon, WI (US)

(72) Inventor: Chad Joseph Hildreth, Lake Nebagamon, WI (US)

( * ) Notice: Subject to any disclaimer, the term of this patent is extended or adjusted under 35 U.S.C. 154(b) by 0 days.

(21) Appl. No.: 17/896,001

(22) Filed: Aug. 25, 2022

(51) Int. Cl.
*E06B 1/60* (2006.01)
*E06B 1/52* (2006.01)
*E04F 21/00* (2006.01)

(52) U.S. Cl.
CPC ..... *E06B 1/6076* (2013.01); *E04F 21/0015* (2013.01); *E06B 1/52* (2013.01)

(58) Field of Classification Search
CPC ..... F16B 35/005; F16B 5/02; F16B 23/0061; E04F 21/0015; E06B 1/52; E06B 1/6076
See application file for complete search history.

(56) References Cited

U.S. PATENT DOCUMENTS 2,595,506 A * 5/1952 Backman ..... E06B 1/18 52/215
2,860,744 A * 11/1958 Mascari ..... E06B 1/20 52/212
3,667,338 A * 6/1972 Johansson ..... F16B 5/0283 411/378
3,685,226 A * 8/1972 Richter ..... E06B 1/603 49/505
4,043,239 A * 8/1977 DeFusco ..... F16B 5/0233 411/432
4,453,346 A * 6/1984 Powell ..... E06B 1/6076 49/404
4,912,879 A * 4/1990 Mozuras ..... E06B 1/20 49/505
4,930,959 A * 6/1990 Jagelid ..... F16B 5/0283 411/533
4,986,044 A * 1/1991 Funari ..... E06B 1/20 52/211
5,154,019 A * 10/1992 Day ..... E06B 1/6076 49/504
5,187,898 A * 2/1993 McKann ..... E06B 1/20 49/505

(Continued)

FOREIGN PATENT DOCUMENTS

DE 1809532 A1 * 8/1969
SE 502799 C2 * 1/1996 ..... E06B 1/6076

(Continued)

*Primary Examiner* — James M Ference

(57) ABSTRACT

A doorframe fastening device facilitating the plumbing and mounting of a doorframe within a door opening comprises an insert including a tube and a flange. The flange is attached to and extends radially from a first end of the tube, which is internally and externally threaded. The insert is insertable into a void in a doorframe that is shaped complementarily to the insert. A nut can be threaded onto a second end of the tube to attach the insert to the doorframe. A set screw is threadedly inserted into the tube from the first end and is selectively extensible from the second end of the tube and into abutment with a framework, which defines a door opening. The doorframe thus is selectively adjustable relative to the framework. A mounting screw is insertable through a channel, which extends axially through the set screw, to attach the doorframe to the framework.

10 Claims, 11 Drawing Sheets

(56) References Cited

U.S. PATENT DOCUMENTS 5,205,692 A * 4/1993 Kelbert ..... F16B 5/0216 411/338
5,288,191 A * 2/1994 Ruckert ..... F16B 5/0233 411/432
5,333,976 A * 8/1994 Dobbrunz ..... F16B 5/0233 411/383
5,345,722 A * 9/1994 McKann ..... E06B 1/20 49/505
5,845,439 A * 12/1998 Hendley ..... E06B 1/30 49/501
5,941,033 A * 8/1999 Adams ..... E06B 1/30 52/211
6,167,663 B1 * 1/2001 Nakamoto ..... F16B 5/0283 52/204.56
6,286,274 B1 * 9/2001 McKann ..... E06B 1/20 49/505
6,308,476 B1 * 10/2001 Nakamoto ..... E06B 1/6076 52/213
6,585,447 B2 * 7/2003 Schwarzbich ..... F16B 5/0233 411/546
6,789,993 B2 * 9/2004 Ozawa ..... F16B 33/02 411/432
6,826,878 B1 * 12/2004 Rovtar ..... E06B 1/6076 411/383
6,884,014 B2 * 4/2005 Stone ..... F16B 5/025 411/352
7,987,637 B2 * 8/2011 Smith ..... E06B 1/6076 49/504
8,016,534 B2 * 9/2011 Nilsen ..... F16B 39/025 411/362
8,267,630 B2 * 9/2012 Moon ..... F16B 39/06 411/110
8,806,812 B2 * 8/2014 Kolovich ..... E06B 1/6046 52/126.4
9,194,170 B2 * 11/2015 Eis ..... E06B 1/6076
9,926,736 B2 * 3/2018 Clarke, Jr. ..... E04F 21/0015
10,246,886 B2 * 4/2019 Mitchell ..... E04F 21/0015
10,465,432 B1 * 11/2019 Brannon ..... E06B 1/6076
11,047,410 B1 * 6/2021 Reed, Sr. ..... F16B 23/0069
11,236,778 B2 * 2/2022 Size, Jr. ..... F16B 37/125
2002/0176739 A1 * 11/2002 Goto ..... F16B 5/0233 403/301
2005/0025607 A1 * 2/2005 Guantonio ..... F16B 39/12 411/222
2005/0050818 A1 * 3/2005 Chen ..... F16B 5/0233 52/263
2007/0245685 A1 * 10/2007 Gaydos ..... E06B 1/6076 52/783.1
2008/0067811 A1 * 3/2008 Nilsen ..... F16B 35/00 285/328
2009/0025320 A1 * 1/2009 Wagner ..... E06B 1/52 52/745.15
2009/0241610 A1 * 10/2009 Watts ..... E06B 3/9643 70/91
2011/0008125 A1 * 1/2011 Moon ..... F16B 5/02 411/108
2012/0317789 A1 * 12/2012 Moon ..... F16B 39/06 29/525.11
2020/0291982 A1 * 9/2020 Size, Jr. ..... F16B 5/0241
2020/0291983 A1 * 9/2020 Size, Jr. ..... F16B 5/0241
2020/0386258 A1 * 12/2020 Size, Jr. ..... F16B 33/002

FOREIGN PATENT DOCUMENTS

SE 521724 C2 * 12/2003 ..... E06B 1/60
WO WO-9622442 A1 * 7/1996 ..... E06B 1/6076

* cited by examiner

DOORFRAME FASTENING DEVICE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fastening devices and more particularly pertains to a new fastening device allowing for easy leveling, plumbing, squaring, and mounting of a doorframe within a door opening. The present invention discloses a new fastening device that enables a method of mounting a doorframe within a door opening without using shims.

(2) Description of Related Art Including Information Disclosed Under 37 CFR 1.97 and 1.98

The prior art relates to fastening devices, which may comprise shimming devices that are attachable to either a doorframe or a framework that defines a door opening. Prior art fastening devices for shimming doorframes also comprise hollow metal doorframes having outwardly extendable bolts to engage the framework. Related prior art comprises doorframes that are either one or both of height adjustable and width adjustable. What is lacking in the prior art is a fastening device which can be fastened to a doorframe within a complementarily shaped void, which has a selectively extensible element for engaging the framework, and through which a mounting screw can be screwed to mount the door within the door opening.

BRIEF SUMMARY OF THE INVENTION

An embodiment of the disclosure meets the needs presented above by generally comprising an insert, which in turn comprises a tube and a flange. The flange is attached to and extends radially from a first end of the tube, which is internally and externally threaded. The insert is configured for insertion into a void in a doorframe that is shaped complementarily to the insert. A nut can be threaded onto a second end of the tube to attach the insert to the doorframe. A set screw is threadedly inserted into the tube from the first end and is configured to be selectively extended from the second end of the tube and into abutment with a framework, which defines a door opening. The doorframe thus is selectively adjustable relative to the framework. A channel, which extends axially through the set screw, is configured for insertion of a mounting screw to fixedly attach the doorframe to the framework.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
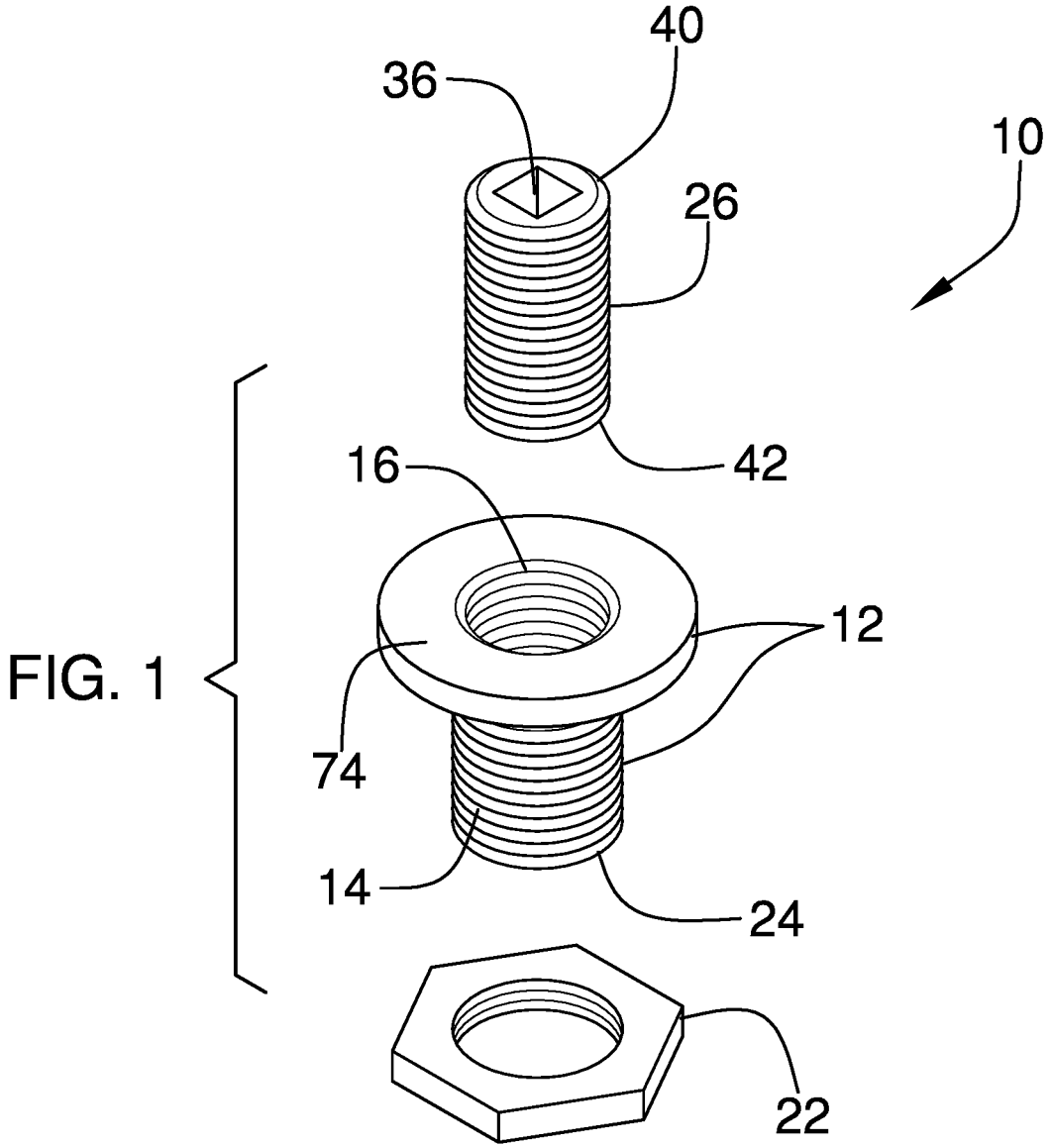
FIG. 1 is a top isometric perspective view of a doorframe fastening device according to an embodiment of the disclosure.

With reference now to the drawings, and in particular to FIGS. 1 through 12 thereof, a new fastening device embodying the principles and concepts of an embodiment of the disclosure and generally designated by the reference numeral 10 will be described.

As best illustrated in FIGS. 1 through 12, the doorframe fastening device 10 generally comprises an insert 12, which in turn comprises a tube 14 and a flange 74. The flange 74 is attached to and extends radially from a first end 16 of the tube 14, which is internally and externally threaded. The insert 12 is configured for insertion into a void 18, which is positioned in a doorframe 20 and which is shaped complementarily to the insert 12. A nut 22 can be threaded onto a second end 24 of the tube 14 to attach the insert 12 to the doorframe 20. A set screw 26 is threadedly inserted into the tube 14 from the first end 16 and is configured to be selectively extended from the second end 24 of the tube 14 and into abutment with a framework 28, which defines a door opening 30. The doorframe 20 thus is selectively adjustable relative to the framework 28.

Figure 2:
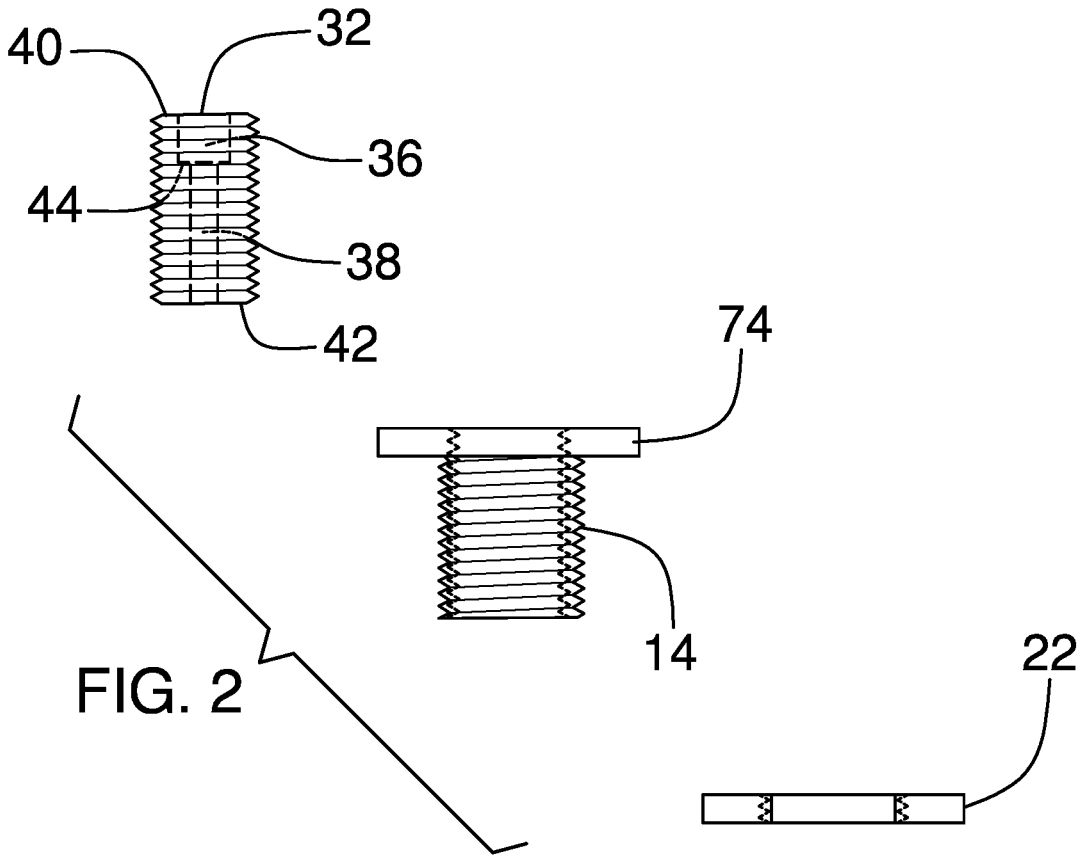
FIG. 2 is a side view of an embodiment of the disclosure.
Figure 3:
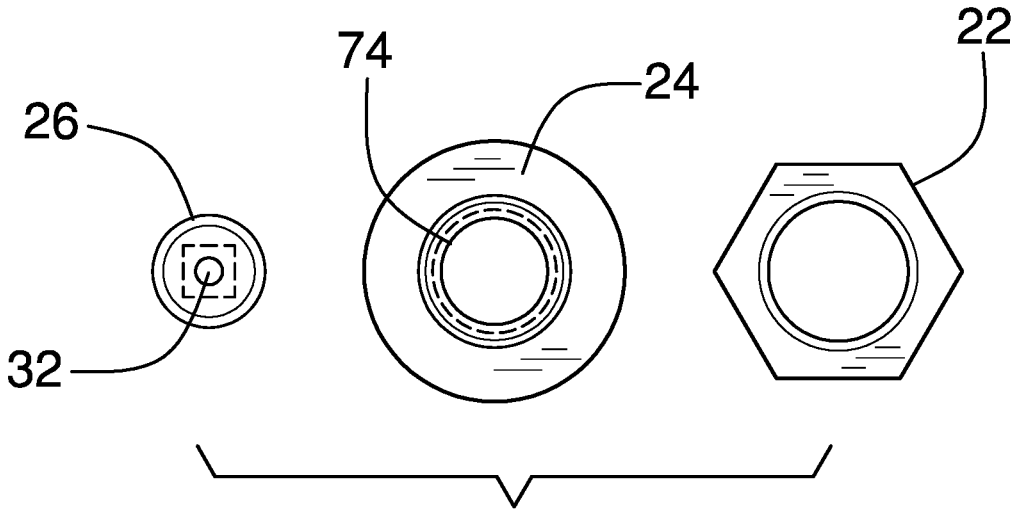
FIG. 3 is a bottom view of an embodiment of the disclosure.

A channel 32, which extends axially through the set screw 26, is configured for insertion of a mounting screw 34 to fixedly attach the doorframe 20 to the framework 28. The channel 32 comprises a first section 36 and a second section 38. The first section 36 extends into a first terminus 40 of the set screw 26 and is shaped complementarily to a bit of a rotary tool (not shown). The first section 36 thus is configured for insertion of the bit, positioning a user for actuating the rotatory tool to drive the set screw 26 into the tube 14 and into abutment with the framework 28, thereby adjusting the doorframe 20 relative to the framework 28. The second section 38 extends from the first section 36 to a second terminus 42 of the set screw 26. As is shown in FIG. 2, the first section 36 is substantially cuboid and is configured for insertion of a square bit. The present invention also anticipates the first section 36 being of alternative shapes so as to be complementary to torx bits, hexagonal bits, and the like.

As is shown in FIG. 2, the second section 38 is circular and circumferentially smaller than the first section 36. A ledge 44 thus exists between the second section 38 and the first section 36 and is configured to engage a head 72 of the mounting screw 34 as it is screwed through the channel 32 into the framework 28.

Currently, most doorframes are shimmed by inserting the shims of a pair of shims (not shown) from opposing directions into a gap 70 between a doorframe 20 and a framework 28 of a door opening 30 in which the doorframe 20 is to be installed. The shims overlap and are driven alternately into the gap 70 by hitting them with a hammer until the doorframe 20 is positioned as required. This process is repeated at multiple points around the doorframe 20 and is quite time consuming. A mounting screw 34 then must be driven through the doorframe 20 and each pair of shims, followed by trimming of each shim of each pair of shims. The present invention provides a significant advantage in ease of use, time requirements, and precision of installation of a doorframe 20. Additionally, a doorframe 20 installed using doorframe fastening devices 10 can be adjusted easily should there be shifting of the framework 28 over time.

The present invention also anticipates a plurality of inserts 12 being preinstalled in a doorframe 20 by a manufacturer of the doorframe 20. The inserts 12 could be held in place with nuts 22, as above, or they could be fixedly attached by other means, such as, but not limited to, adhesives, press fitting, welding, and the like, depending upon the materials used for manufacturing of the doorframe 20 and the inserts 12. The tube 14 of each insert 12 would have a set screw 26 threadedly preinserted.

Figure 4:
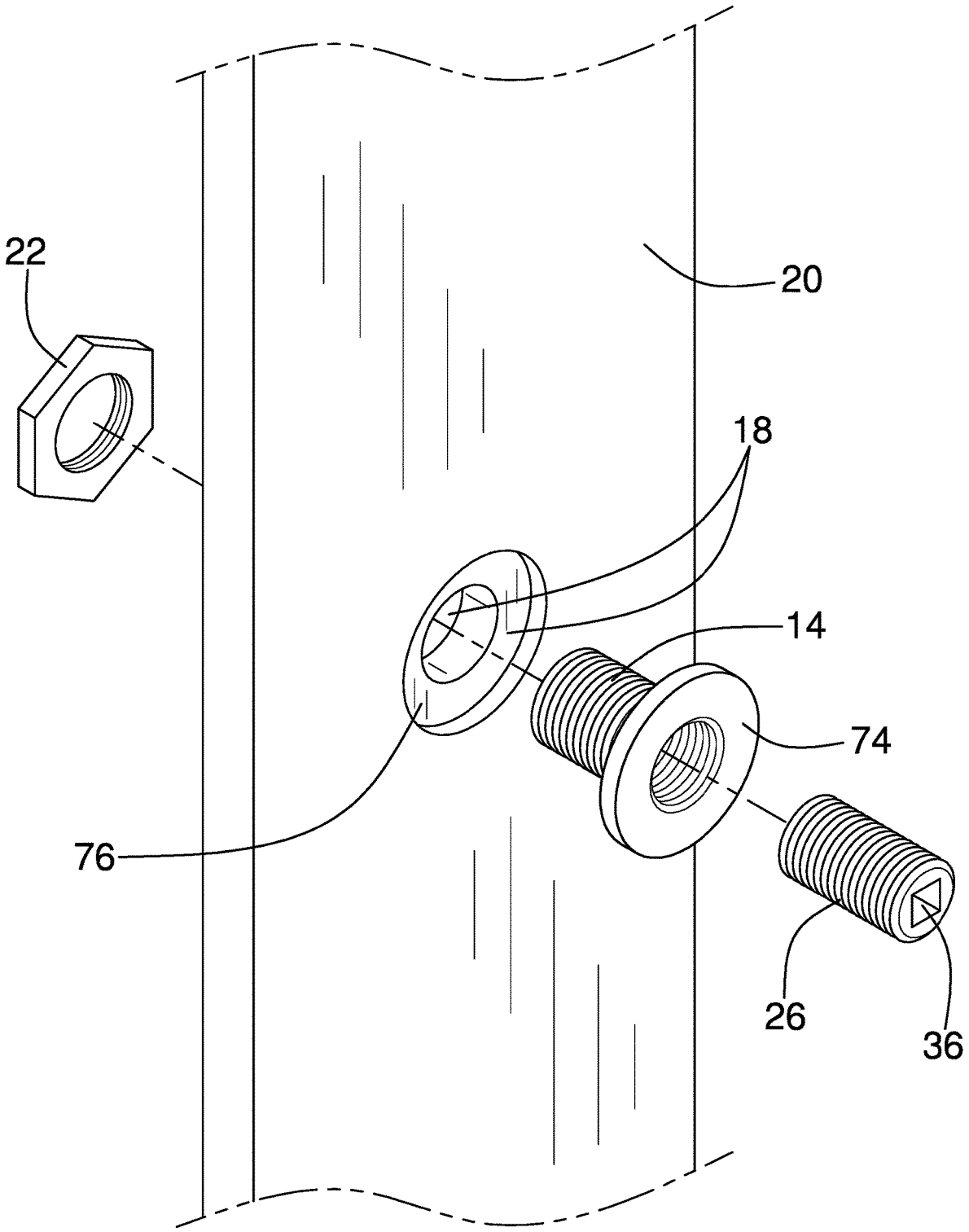
FIG. 4 is an in-use view of an embodiment of the disclosure.
Figure 5:
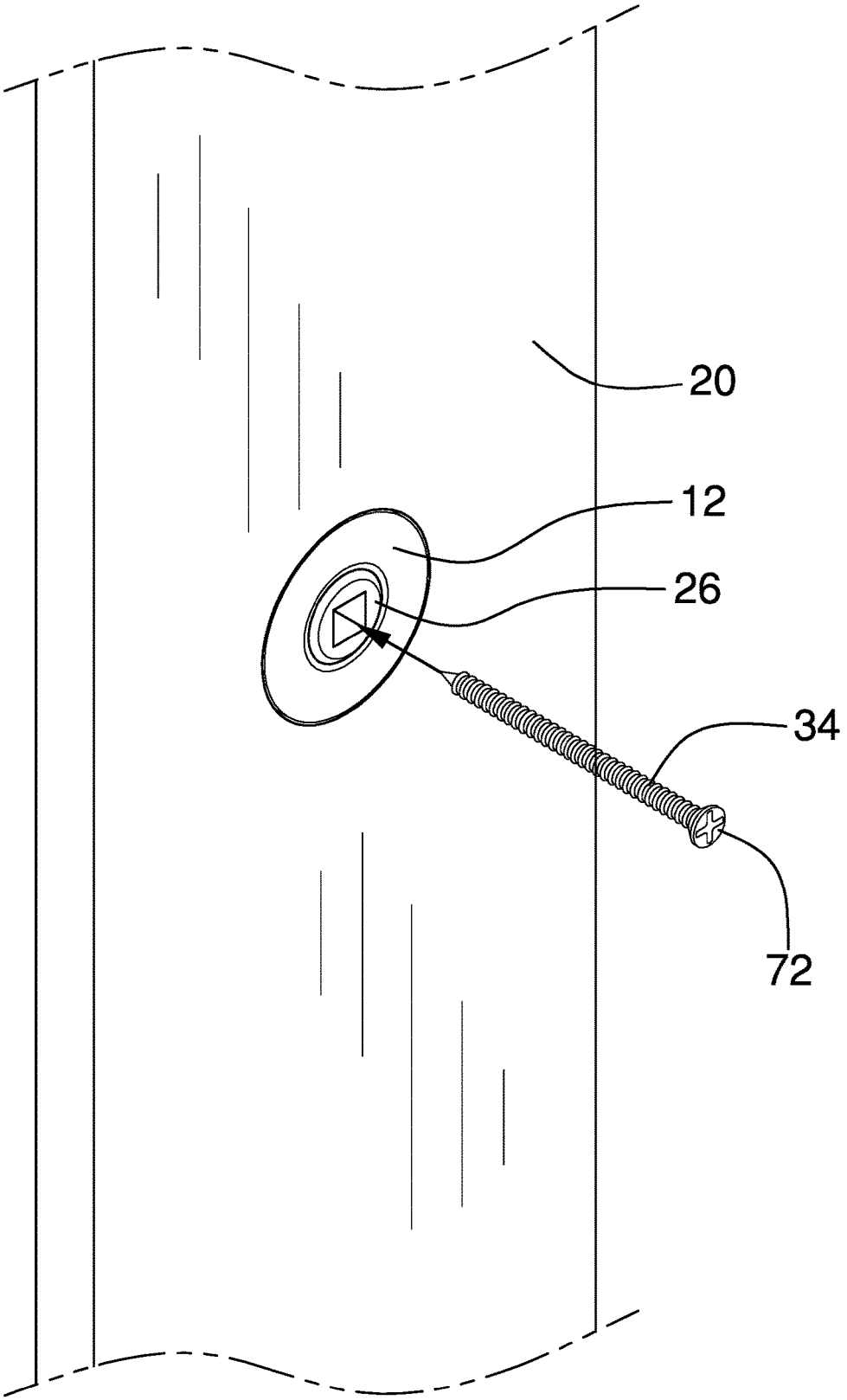
FIG. 5 is an in-use view of an embodiment of the disclosure.
Figure 6:
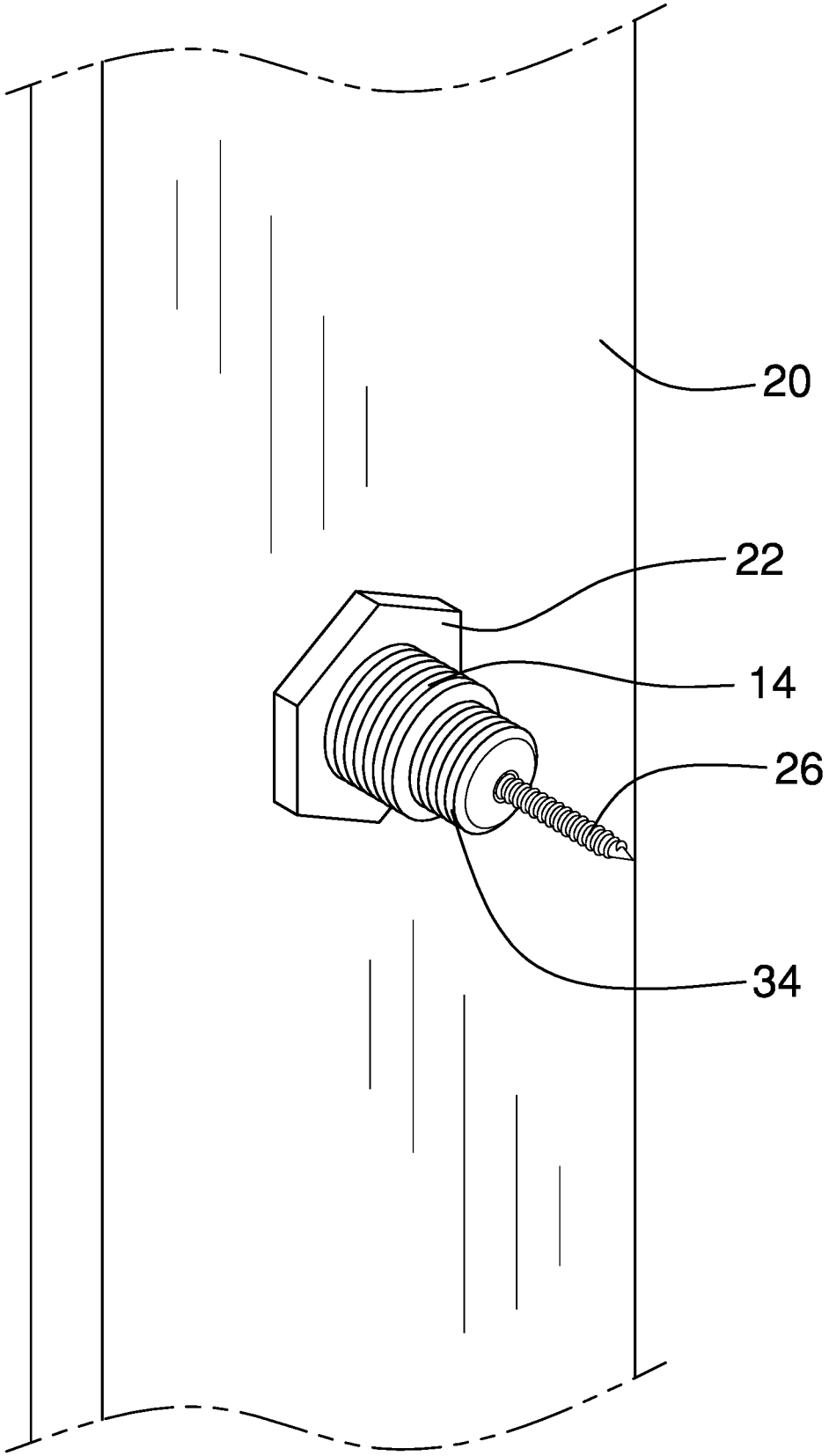
FIG. 6 is an in-use view of an embodiment of the disclosure.
Figure 7:
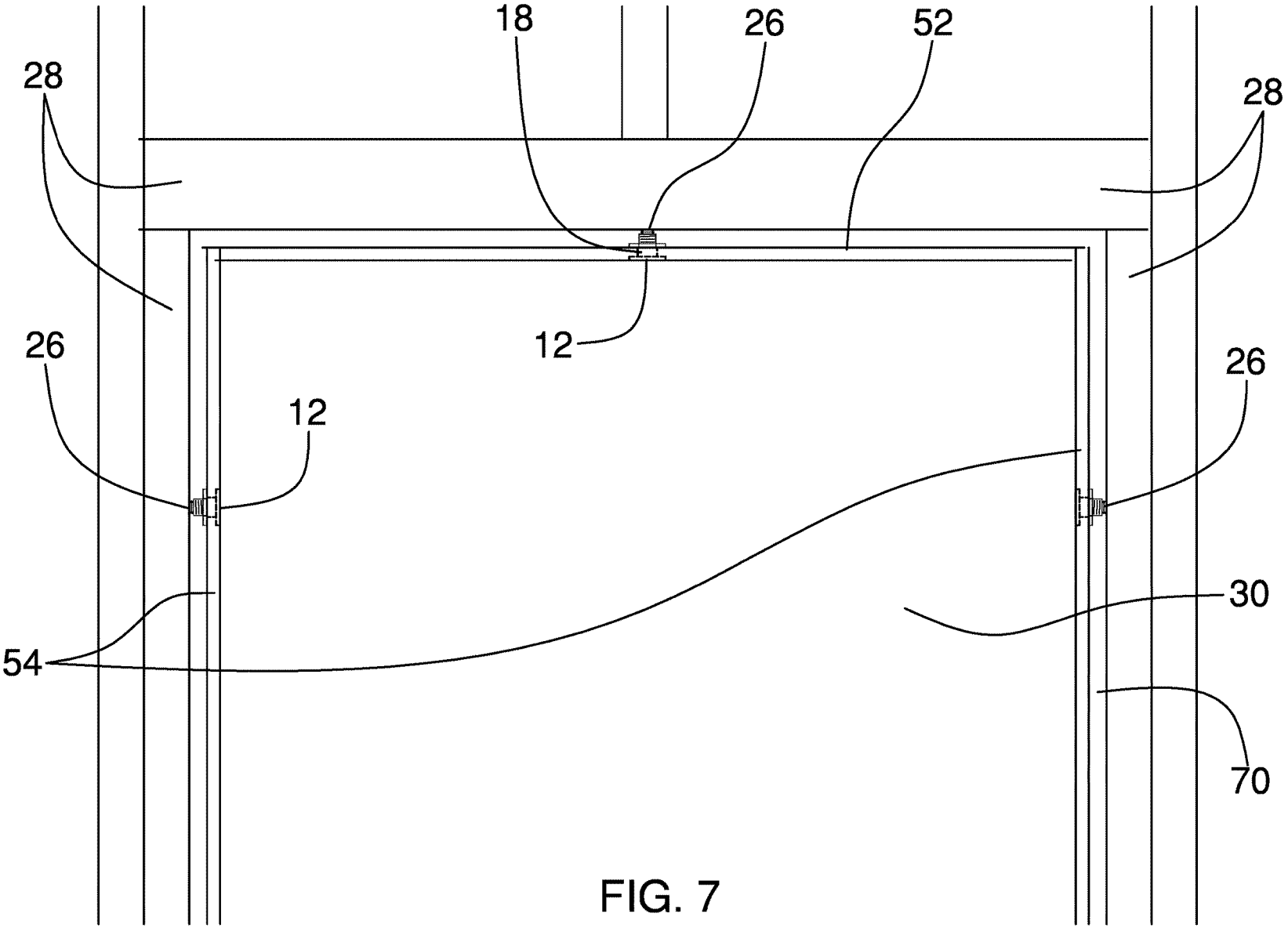
FIG. 7 is an in-use view of an embodiment of the disclosure.
Figure 8:
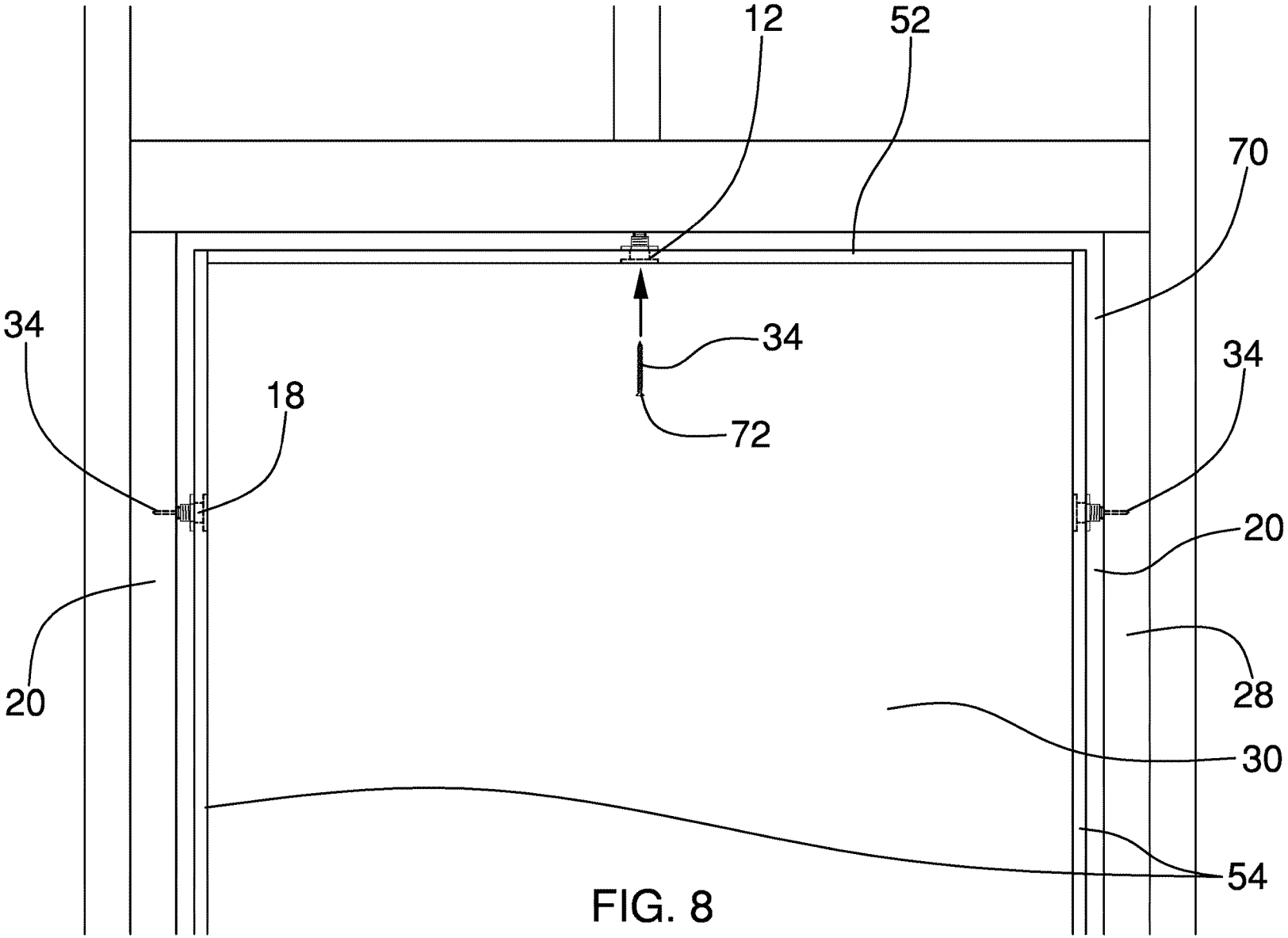
FIG. 8 is an in-use view of an embodiment of the disclosure.
Figure 9:
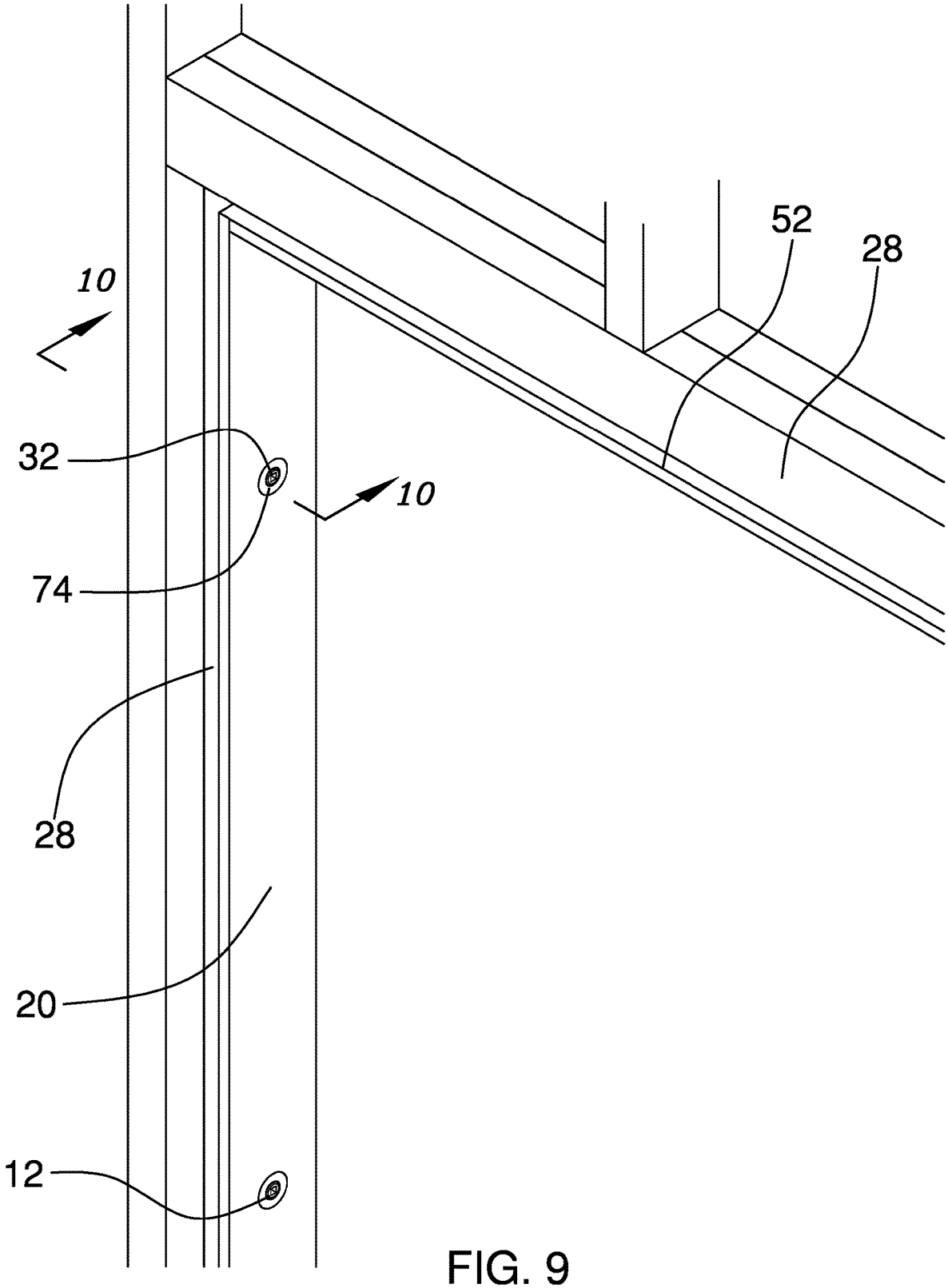
FIG. 9 is an in-use view of an embodiment of the disclosure.
Figure 10:
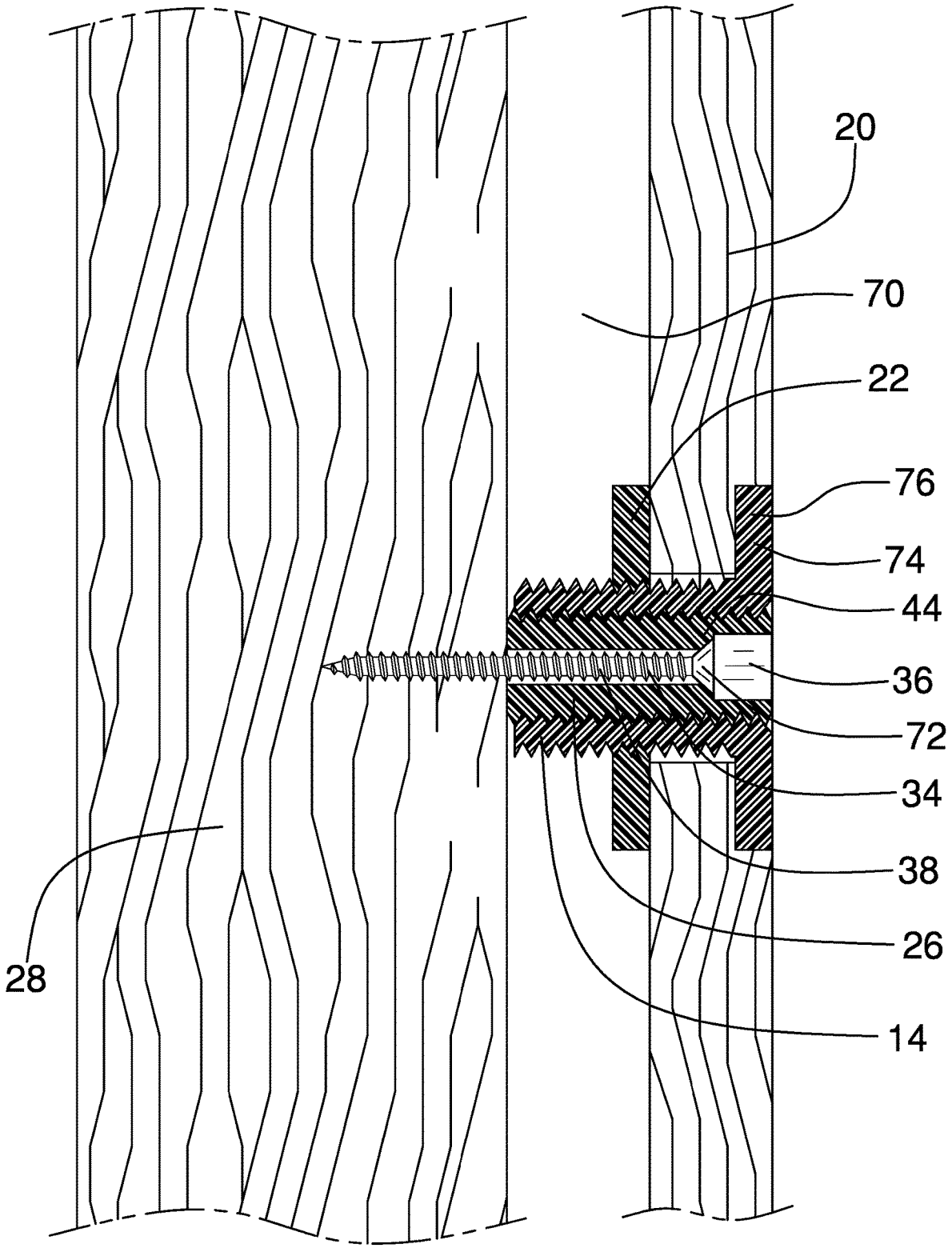
FIG. 10 is a cross-sectional view of an embodiment of the disclosure.
Figure 11:
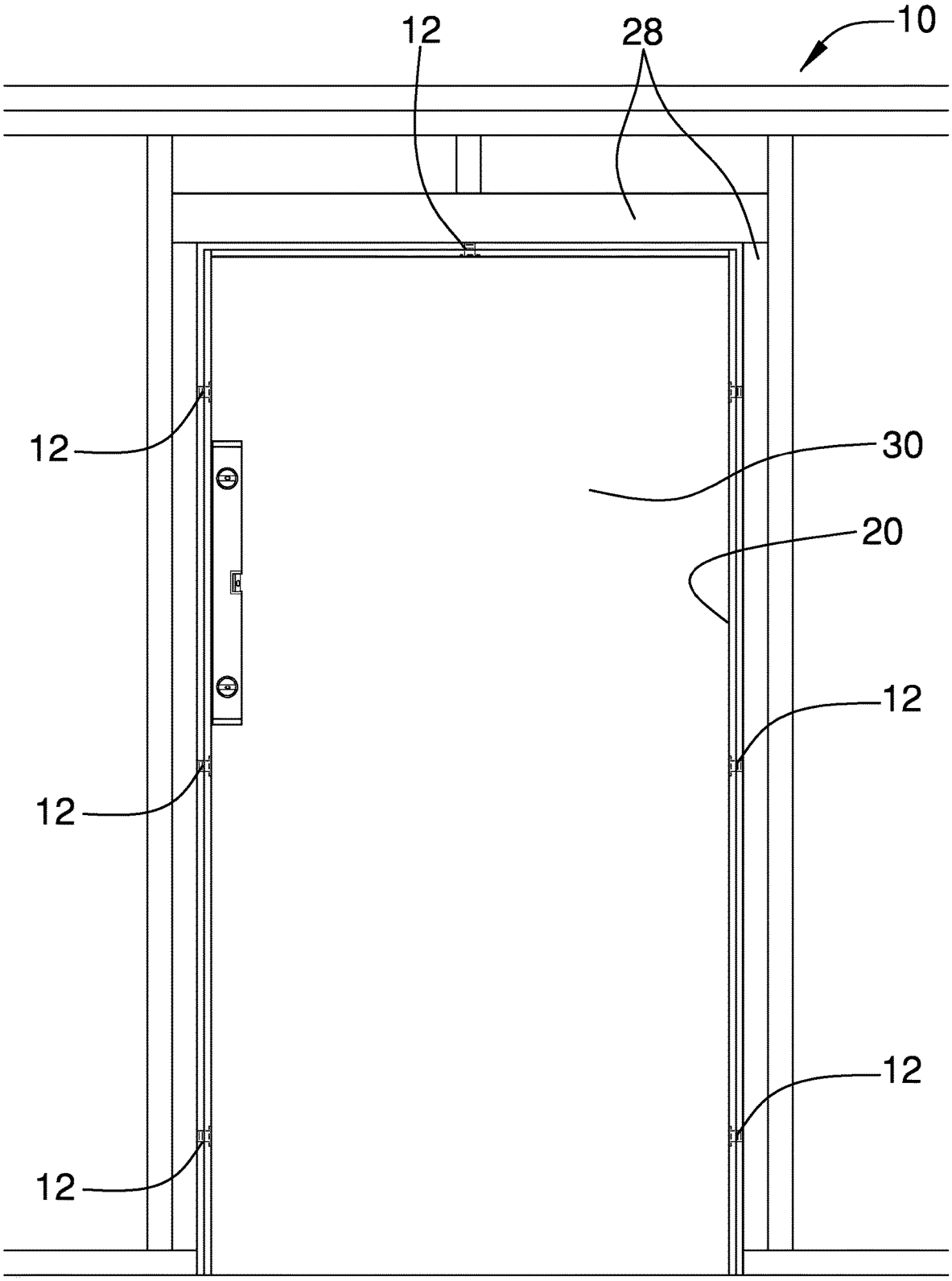
FIG. 11 is an in-use view of an embodiment of the disclosure.
Figure 12:
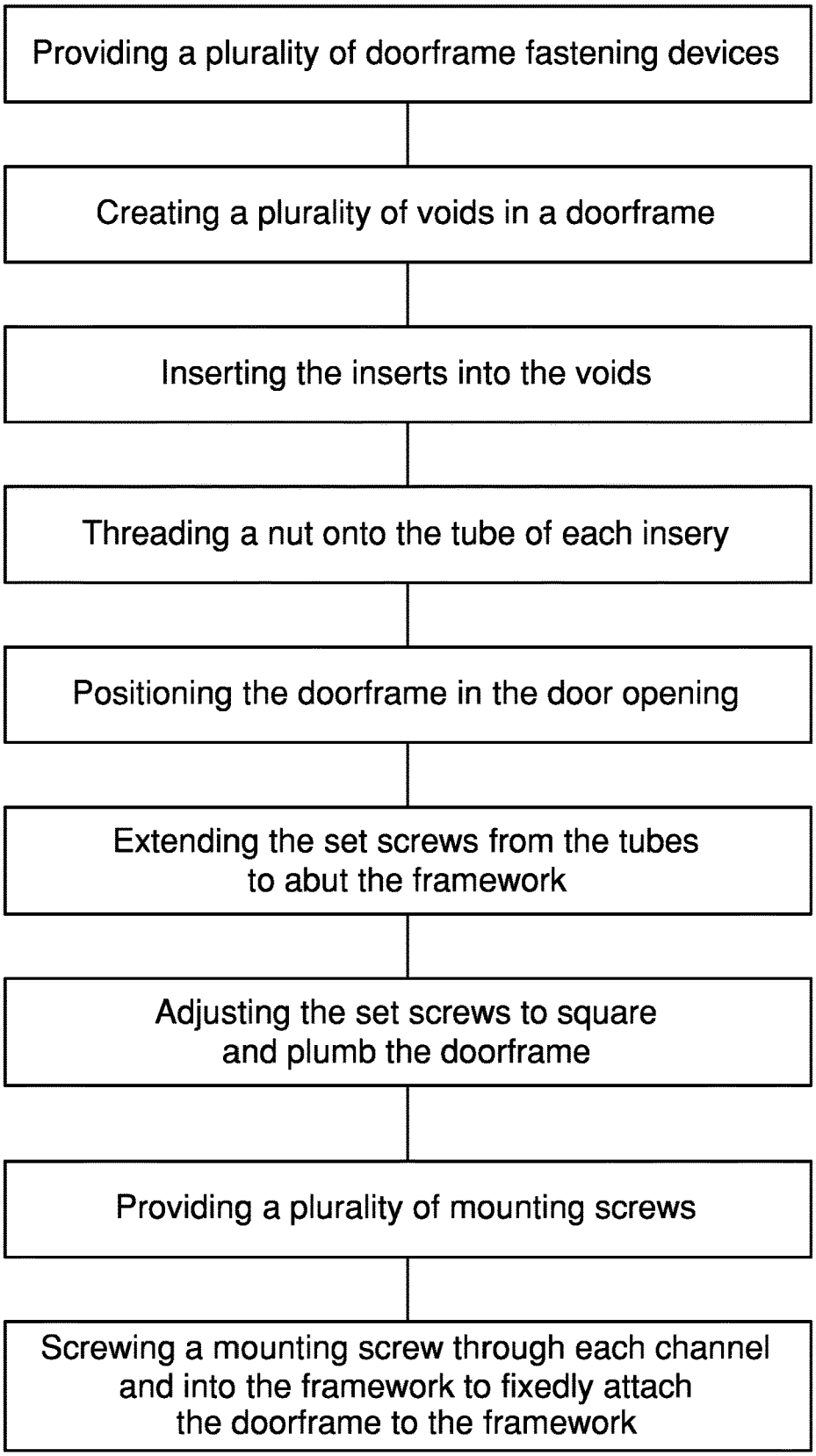
FIG. 12 is flow diagram for a method utilizing an embodiment of the disclosure.

The doorframe fastening device 10 enables a method of mounting a doorframe to a framework of a door opening 46. The method 46 comprises a first step 48 of providing a plurality of doorframe fastening devices 10 according to the specification above. A second step 50 of the method 46 is creating a plurality of voids 18 in the doorframe 20. The voids 18 are shaped complementary to the inserts 12. As is shown in FIG. 4, the flange 74 is substantially circular, which facilitates creation of a complementary shaped recess 76 for the flange 74 in the doorframe 20 as it can be generated using a rotatory tool. As is shown in FIG. 11, the second step 50 of creating a plurality of voids 18 in the doorframe 20 may entail creation of a void 18 in a top 52 of the doorframe 20, substantially equally distant from the opposed sides 54 of the doorframe 20, and creation of three voids 18 in each opposed side 54 of the doorframe 20.

A third step 56 of the method 46 is inserting the inserts 12 into the voids 18 so that each void 18 is occupied by a respective insert 12. A fourth step 58 of the method 46 is threading a respective nut 22 onto the tube 14 of each insert 12 so that the inserts 12 are attached to the doorframe 20. A fifth step 60 of the method 46 is positioning the doorframe 20 in the door opening 30. A sixth step 62 of the method 46 is selectively extending the set screws 26 from the tubes 14 such that each set screw 26 extends from a second end 24 of an associated tube 14 into abutment with the framework 28. A seventh step 64 of the method 46 is selectively adjusting the set screws 26 so that the doorframe is square, the top 52 of the doorframe 20 is horizontal, and opposed sides 54 of the doorframe 20 are plumb.

An eighth step 66 of the method 46 is providing a plurality of mounting screws 34. A ninth step 68 of the method 46 is screwing a mounting screw 34 through each channel 32 and into the framework 28 to fixedly attach the doorframe 20 to the framework 28.

Variations in the method 46 are anticipated by the present invention and are known to those skilled in the art of mounting doorframes within door openings. For example, a user may elect to plumb one opposed side 54 of the doorframe 20 and fixedly attach it to the framework 28, then square and level the top 52 of the doorframe 20 and fixedly attach it to the framework 28, before finally plumbing the other opposed side 54 and fixedly attaching it to the framework 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A doorframe fastening device comprising:

an insert comprising:

a tube, the tube being internally and externally threaded, and a flange attached to and extending radially from a first end of the tube;

a nut threadedly attachable to the tube, wherein the insert is configured for insertion into a void in a doorframe shaped complementarily to the insert, positioning the nut for being threaded onto a second end of the tube for attaching the insert to the doorframe;

a set screw threadedly inserted into the tube from the first end, wherein the set screw is configured for being selectively extended from the second end of the tube into abutment with a framework defining a door opening, such that the doorframe is selectively adjustable relative to the framework; and a channel extending axially through the set screw, wherein the channel is configured for insertion of a mounting screw for fixedly attaching the doorframe to the framework.

2. The doorframe fastening device of claim 1, wherein the flange is substantially circular.

3. The doorframe fastening device of claim 1, wherein the channel comprises:

a first section extending into a first terminus of the set screw, the first section being shaped complementarily to a bit of a rotary tool, wherein the first section is configured for insertion of the bit, positioning a user for actuating the rotatory tool for driving the set screw into the tube and adjusting the doorframe relative to the framework; and a second section extending from the first section to a second terminus of the set screw, the second section being circular and circumferentially smaller than the first section defining a ledge between the second section and the first section, wherein the ledge is configured for engaging a head of the mounting screw.

4. The doorframe fastening device of claim 3, wherein the first section is substantially cuboidal and configured for insertion of a square bit.

5. A doorframe fastening system comprising:

a doorframe complementary to a door opening defined by a framework;

a plurality of inserts, each of the plurality of inserts comprising:

a tube, the tube being internally and externally threaded, and a flange attached to and extending radially from a first end of the tube;

a plurality of voids positioned in the doorframe, the plurality of voids being shaped complementarily to the plurality of inserts, the plurality of voids being occupied by the plurality of inserts;

a plurality of nuts, each of the plurality of nuts being threadedly attached to a respective one of the tubes, such that an associated insert of the plurality of inserts is attached to the doorframe;

a plurality of set screws, each of the plurality of set screws being threadedly inserted into a respective one of the tubes from the first end of the respective tube, wherein each of the plurality of set screws is configured for selective extension from an associated one of the tubes and into abutment with the framework for adjusting the doorframe relative to the framework; and a plurality of channels, each of the plurality of channels extending axially through a respective set screw of the plurality of set screws, wherein the channel is configured for insertion of a respective mounting screw of a plurality a mounting screws for fixedly attaching the doorframe to the framework.

6. The doorframe fastening system of claim 5, wherein the flange is substantially circular.

7. The doorframe fastening system of claim 5, wherein each of the plurality of channels comprises:

a first section extending into a first terminus of the set screw, the first section being shaped complementarily to a bit of a rotary tool, wherein the first section is configured for insertion of the bit, positioning a user for actuating the rotatory tool for driving the set screw into the tube and adjusting the doorframe relative to the framework; and a second section extending from the first section to a second terminus of the set screw, the second section being circular and circumferentially smaller than the first section defining a ledge between the second section and the first section, wherein the ledge is configured for engaging a head of the mounting screw.

8. The doorframe fastening system of claim 7, wherein the first section is substantially cuboidal and configured for insertion of a square bit.

9. A method of mounting a doorframe to a framework of a door opening, the method comprising the steps of:

providing a plurality of doorframe fastening devices, each doorframe fastening device comprising:

an insert comprising:

a tube, the tube being internally and externally threaded, and a flange attached to and extending radially from a first end of the tube, a nut threadedly attachable to the tube, a set screw threadedly inserted into the tube from the first end, and a channel extending axially through the set screw;

creating a plurality of voids in a doorframe, the plurality of voids being shaped complementary to the inserts;

inserting the inserts into the plurality of voids, such that each of the plurality of voids is occupied by a respective one of the inserts;

threading a respective one of the nuts onto the tube of each of the inserts, such that the inserts are attached to the doorframe;

positioning the doorframe in the door opening;

selectively extending the set screws from the tubes such that each of the set screws extends from a second end of an associated one of the tubes to abut the framework;

selectively adjusting the set screws so that the doorframe is square, a top of the doorframe is horizontal, and opposed sides of the doorframe are plumb;

providing a plurality of mounting screws; and screwing a mounting screw of the plurality of mounting screws through each of the channels and into the framework to fixedly attach the doorframe to the framework.

10. The method of claim 9, wherein the step of creating a plurality of voids in the doorframe entails creation of a void in the top of the doorframe, substantially equally distant from the opposed sides, and three voids in each of the opposed sides of the doorframe.

* * * * *